US007073917B2

(12) United States Patent
VanderSchuit

(10) Patent No.: US 7,073,917 B2
(45) Date of Patent: Jul. 11, 2006

(54) ILLUMINATED IMPLEMENTS FOR DRINKING AND/OR EATING AND RELATED METHODS

(76) Inventor: Carl R. VanderSchuit, 751 Turquoise St., San Diego, CA (US) 92109

( * ) Notice: Subject to any disclaimer, the term of this patent is extended or adjusted under 35 U.S.C. 154(b) by 70 days.

(21) Appl. No.: 10/851,510

(22) Filed: May 21, 2004

(65) Prior Publication Data

US 2005/0259435 A1 Nov. 24, 2005

(51) Int. Cl.
*F21V 33/00* (2006.01)

(52) U.S. Cl. ..... 362/96; 362/101; 362/551; 362/562; 362/222

(58) Field of Classification Search ..... 362/562, 362/96, 101
See application file for complete search history.

(56) References Cited

U.S. PATENT DOCUMENTS

| | | | | |
|---|---|---|---|---|
| 2,521,449 | A * | 9/1950 | Cossa | 362/812 |
| 4,252,273 | A * | 2/1981 | Karterman | 239/33 |
| 5,070,435 | A * | 12/1991 | Weller | 362/551 |
| 5,931,383 | A * | 8/1999 | Palmer et al. | 239/33 |
| 6,054,156 | A * | 4/2000 | Rudell et al. | 426/104 |
| 6,213,616 | B1 * | 4/2001 | Chien | 362/84 |
| 6,416,198 | B1 | 7/2002 | Vanderschuit | |
| 2003/0026088 | A1 | 2/2003 | Vanderschuit | |

FOREIGN PATENT DOCUMENTS

| | | | |
|---|---|---|---|
| CH | 662 931 | A | 11/1987 |
| DE | 299 18 185 | U | 1/2000 |
| EP | 0 231 471 | A | 8/1987 |
| GB | 2 381 575 | A | 7/2003 |
| GB | 2 392 973 | A | 3/2004 |
| WO | WO 93 18358 | A | 9/1993 |

OTHER PUBLICATIONS

Pending U.S. Appl. No. 10/341,239 entitled Mood-Enhancing Illumination Apparatus, Vanderschuit, Jan. 13, 2003.
Pending U.S. Appl. No. 10/606,314 entitled Lighted Hat, Vanderschuit, Jun. 25, 2003.
Pending U.S. Appl. No. 10/606,324 entitled Lighting Device, Vanderschuit, Jun. 25, 2003.
Pending U.S. Appl. No. 10/606,325 entitled Lighted Hat, Vanderschuit, Jun. 25, 2003.
Pending U.S. Appl. No. 10/786,995 entitled Therapeutic Devices and Methods for Applying Therapy, Vanderschuit, Feb. 25, 2004.

(Continued)

*Primary Examiner*—Renee Luebke
*Assistant Examiner*—William J Carter
(74) *Attorney, Agent, or Firm*—Harness, Dickey & Pierce, P.L.C.

(57) ABSTRACT

An implement for use in connection with drinking and/or eating includes a tube having a passage therethrough. A housing for a power source is situated in the passage such that a fluid may be drawn through the passage past the housing. One or more light sources in the tube are powered by the power source. This implement can be used, for example, as a drinking straw and/or a stick for frozen treats.

48 Claims, 4 Drawing Sheets

OTHER PUBLICATIONS

Pending U.S. Appl. No. 10/797,251 entitled Lighted Balloons, Vanderschuit, Mar. 10, 2004.
United Kingdom Combined Search and Examination Report dated Jan. 6, 2004; Application No. GB 0326549.3; 4 pages.
Supplementary European Search Report dated Mar. 1, 2004; App. No. EP 01 93 9305; 3 pages.
European Examination Report dated May 13, 2004; Application No. EP 01 939 305.7, 2 pages.

* cited by examiner

ILLUMINATED IMPLEMENTS FOR DRINKING AND/OR EATING AND RELATED METHODS

FIELD OF THE INVENTION

The present invention relates generally to implement for use in connection with drinking or eating and, more particularly, to illuminated implements for use in consuming beverages and/or food.

BACKGROUND OF THE INVENTION

Eating and drinking have always been associated with entertainment and enjoyment. For example, both adults and children may associate attending parties, picnics, outings and other recreational activities with drinking beverages and eating frozen treats on a stick. It is always desirable to heighten the enjoyment associated with eating and drinking.

The present invention, in one embodiment, is directed to an implement for use in connection with drinking and/or eating. The implement includes a tube having a passage therethrough. A power source is situated in the passage such that a fluid may be drawn through the passage past the power source. One or more light sources in the tube are powered by the power source.

Further areas of applicability of the present invention will become apparent from the detailed description provided hereinafter. It should be understood that the detailed description and specific examples, while indicating embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of embodiments of the invention is merely exemplary in nature and is in no way intended to limit the invention, its application, or uses. Various configurations of the invention are not necessarily drawn to scale in the Figures.

Figure 1:
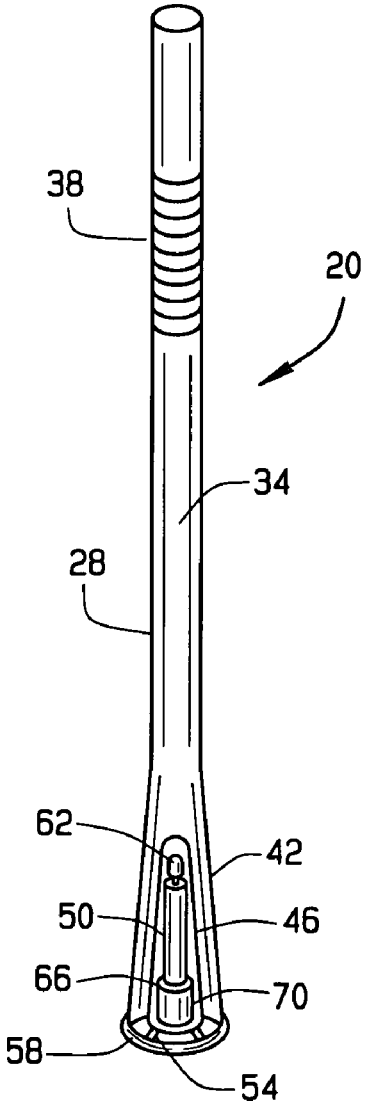
FIG. 1 is a perspective view of an implement for use in connection with drinking and/or eating in accordance with one embodiment of the present invention.

One configuration of an implement for use in connection with drinking and/or eating is indicated generally in FIG. 1 by reference number 20. The implement 20 includes a tube 28 having a passage 34 therethrough. The tube is fabricated, for example, of plastic and the implement 20 can be used, for example, as a drinking straw. At least a portion of the tube 28 is transparent and/or translucent.

The tube 28 may be rigid at least in part and/or flexible at least in part. For example, a corrugated portion 38 of the tube 28 is flexible, although other ways of providing flexibility could also be used. For example, at least a portion of the tube 28 may have a thickness and/or density that allows the tube to be flexed in such portion. The tube 28 and/or passage 34 may vary with respect to width. For example, as shown in FIG. 1, a bottom portion 42 of the tube 28 is flared in shape. Tube and passage widths may also vary with respect to one another, as further described below.

A housing 46 for a power source 50 is situated in the passage 34 such that a fluid may be drawn through the passage 34 past the housing 46 and power source 50. For example, the housing 46 may be attached by one or more spokes 54 to a lower end 58 of the tube. Thus, for example, a beverage being sucked by a user through the implement 20 flows around the spoke(s) 54 into the tube 28. In another configuration, the housing 46 may be situated asymmetrically in the passage 34, for example, attached directly to the tube 28, thereby reducing or eliminating any need for spoke(s). The housing 46 may be fabricated of plastic and may be at least partly transparent and/or translucent. The housing 46 and tube 28 preferably are made of non-toxic materials(s) that remain suitable for contact with consumables when heated and/or frozen.

The implement 20 also includes one or more light sources 62 in the tube 28 powered by the power source 50. The light source(s) 62 may include, for example, one or more light-emitting diodes (LEDs), optical fiber, and/or electroluminescent wires. However, any type of suitable light source may be used. As shown in FIG. 1, the light source 62 includes a LED electrically connected with the power source 50, e.g., a battery or battery pack inside the housing 46. The power source 50 may include an optional control chip 66 for providing blinking, strobing and/or other effects and is operable using a switch 70. The switch 70 may be button-activated, water-activated, touch-, twist- or pressure- activated or activated using other means. Various known switches may be used. Exemplary switches include push-button switches, motion-responsive ball-switch, magnetic switches, mechanical switches, electrical switches, translating-type switch mechanisms, reciprocating switch, manually-operated switches, automatically-operated switches, combinations thereof, etc.

To use the implement 20, a user may activate the switch 70 to switch on the power source 50 and light source(s) 62. In one configuration wherein the switch 70 is liquid-activated, the switch 70 is activated when the user inserts the lower end 58 of the implement 20, for example, into a beverage. The switch 70 may be subsequently deactivated when the implement 20 is removed from the beverage. When the light source 62 is activated, light may pass through the housing 46 and tube 28. Where the housing and/or tube are translucent, the light may cause the housing and/or tube to glow. It can be appreciated that a variety of lighting effects can be produced in the implement 20 and/or in a liquid in which the implement 20 is inserted, depending on the transparency and/or translucence of various portions of the tube 28 and/or housing 46.

Figure 2A:
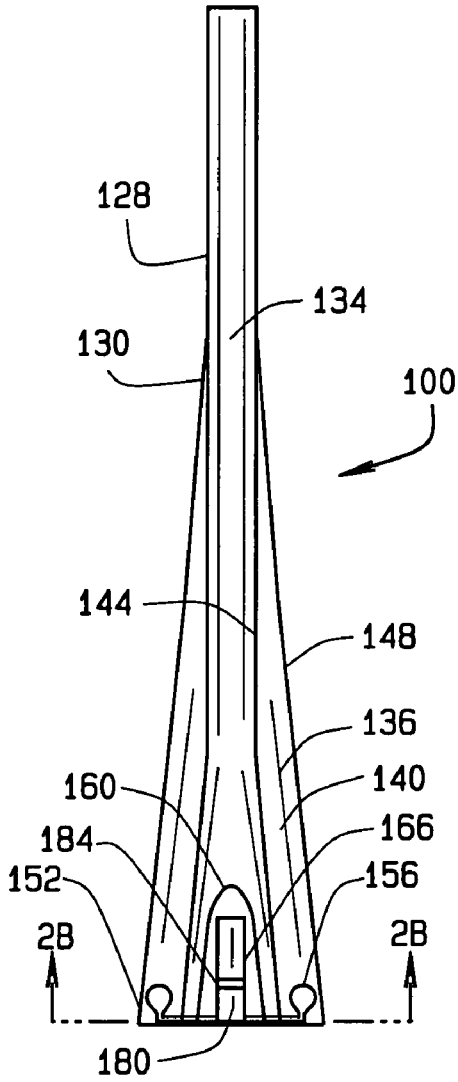
FIG. 2A is a longitudinal sectional view of an implement for use in connection with drinking and/or eating in accordance with one embodiment of the present invention.
Figure 2B:
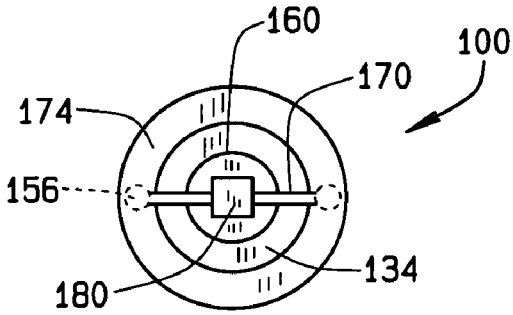
FIG. 2B is a view of the implement shown in FIG. 2A, taken along lines 2B of FIG. 2A.

Another configuration of an implement for use in connection with drinking and/or eating is indicated generally in FIGS. 2A and 2B by reference number 100. The implement 100 includes a tube 128 having a sidewall 130 and a passage 134 therethrough. The tube is fabricated, for example, of plastic. The implement 100 can be used, for example, as a drinking straw, stirrer and/or as a stick for supporting an ice cream bar or other consumable. At least a portion of the tube 128 is transparent and/or translucent. A substance 136, for example, a transparent and/or translucent gel and/or liquid, is sealed in one or more chambers 140 between an inner surface 144 and outer surface 148 of the tube sidewall 130. The substance 136 may include known material(s), e.g., a gel used in reusable freeze packs, and may be colored, fluorescent, glow-in-the-dark and/or the like. The substance 136 and implement 100 preferably are capable of being heated and/or frozen to appropriate temperatures.

The chamber(s) 140 may be tapered and may be sufficient at a lower end 152 of the implement 100 to accommodate one or more light sources 156. Two LEDs 156 are shown in FIGS. 2A and 2B. The chamber(s) 140 could be shaped differently in other configurations. For example, the tube sidewall 130 and chamber(s) 140 could be shaped to form a theme-related or advertisement-related display element as further described below.

A housing 160 for a power source 166 is situated in the passage 134 such that a fluid may be drawn through the passage 134 past the housing 160. For example, the housing 160 may be attached by one or more spokes 170 to a base 174 that seals the chamber 140 and supports the light source(s) 156 at the lower end 152 of the tube. Thus, for example, a beverage being sucked by a user through the implement 100 flows into the tube 128 around the spoke(s) 170. In another configuration, the housing 160 may be situated asymmetrically in the passage 134, for example, attached directly to the tube inner surface 144, thereby reducing or eliminating a need for spoke(s).

The light sources 156 are electrically connected with the power source 166, e.g., a battery or battery pack inside the housing 160. The power source 166 is operable using a switch 180 and may include an optional control chip 184 as previously described with reference to FIG. 1.

The implement 100 may be frozen, for example, for use in connection with cold beverages or when used as a support for frozen consumables. Alternatively, the implement 100 can be heated, for example, in connection with hot beverages. Configurations also are contemplated in which other numbers and/or types of light source(s) are provided. For example, the light source(s) 156 may include one or more LEDs, optical fibers, and/or electroluminescent wires. Additionally or alternatively, in one configuration the housing 160 could include an LED or other light source in the same or a similar manner as described with reference to FIG. 1.

Figure 3A:
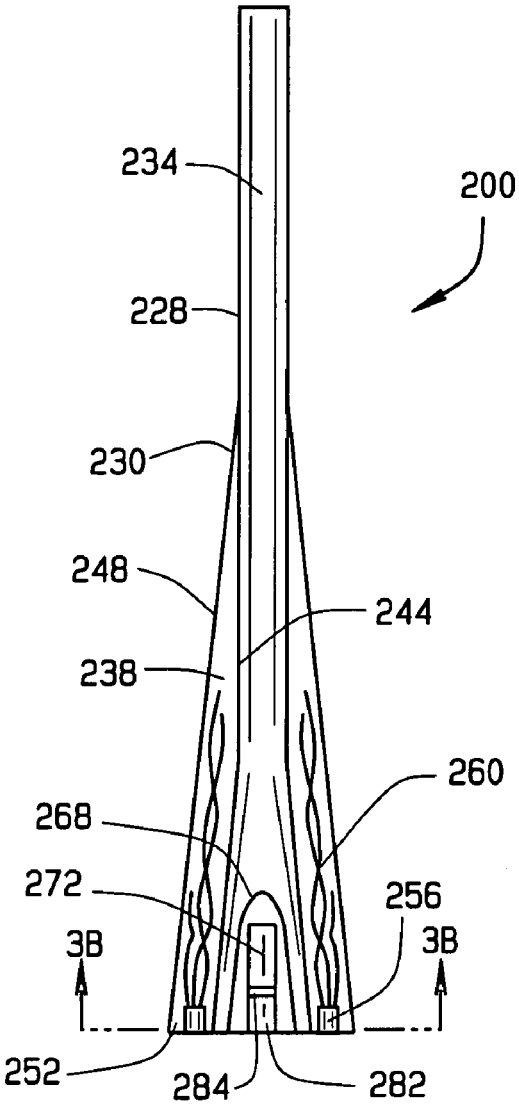
FIG. 3A is a longitudinal sectional view of an implement for use in connection with drinking and/or eating in accordance with one embodiment of the present invention.
Figure 3B:
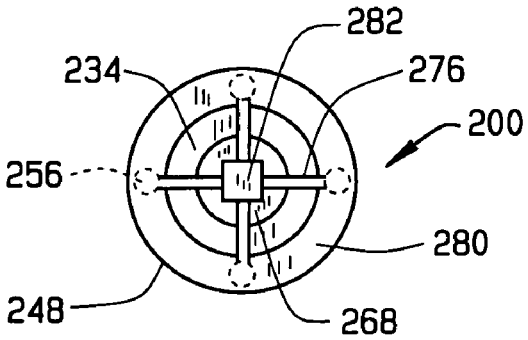
FIG. 3B is a view of the implement shown in FIG. 3A, taken along lines 3B of FIG. 3A.

Another configuration of an implement for use in connection with drinking and/or eating is indicated generally in FIGS. 3A and 3B by reference number 200. The implement 200 includes a tube 228 having a sidewall 230 and a passage 234 therethrough. The tube 228 is fabricated, for example, of plastic. At least a portion of the tube 228 is transparent and/or translucent. One or more chambers 238 may be provided between an inner surface 244 and outer surface 248 of the tube sidewall 230. The chamber(s) 238 may be tapered as shown in FIG. 3A. Other shapes are possible, however, and the distance between inner and outer surfaces 244 and 248 can be varied to provide a desired tube outline and chamber arrangement. For example, the tube 228 and chambers 238 could be shaped to form a theme-related or advertisement-related display element as further described below. As shown in FIGS. 3A and 3B, the chamber 238 is sufficient at a lower end 252 of the implement 200 to accommodate one or more light sources 256. Four light sources 256, e.g., LEDs, are shown in FIGS. 3A and 3B. A plurality of optical fibers 260 are gathered and aligned over each LED 256 relative to a focal point of the LED 256 such that light from the LED 256 is transmitted through the fibers 260. The fibers 260 extend into the chamber 238 and may have various lengths. Configurations also are contemplated in which electroluminescent wire is used instead of, or in addition to, the optical fibers 260.

A housing 268 for a power source 272 is situated in the passage 234 such that a fluid may be drawn through the passage 234 past the housing 268. For example, the housing 268 may be attached by one or more spokes 276 to a base 280 that seals the chamber 238 and supports the light source(s) 256 at the lower end 252 of the tube. Thus, for example, a beverage being sucked by a user through the implement 200 flows into the tube 228 around the spoke(s) 276. In another configuration, the housing 268 may be situated asymmetrically in the passage 234, for example, attached directly to the tube inner surface 244, thereby eliminating a need for spoke(s).

The light sources 256 are electrically connected with the power source 272, e.g., a battery or battery pack inside the housing 268. Source 272 is operable using a switch 282 and may include an optional control chip 284 as previously described with reference to FIG. 1.

Figure 4:
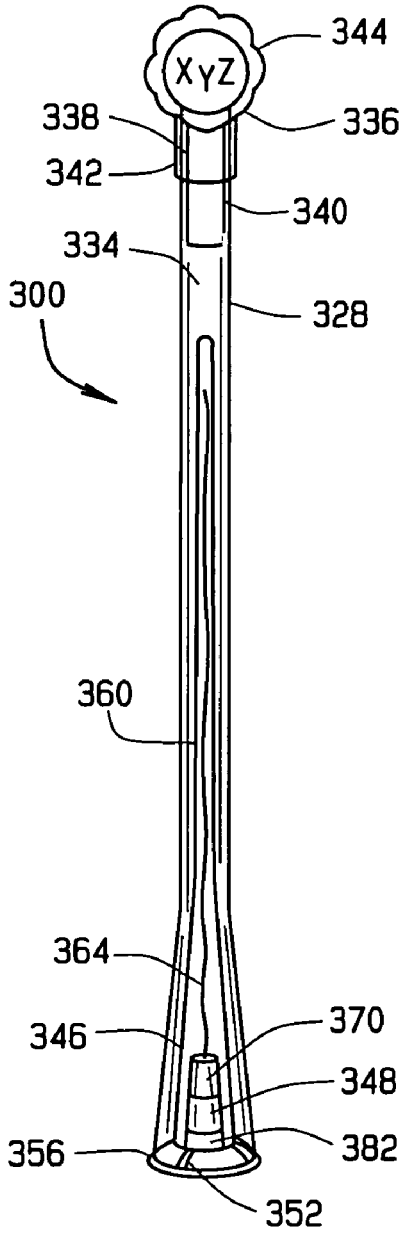
FIG. 4 is a perspective view of an implement for use in connection with drinking and/or eating in accordance with one embodiment of the present invention.

Another configuration of an implement for use in connection with drinking and/or eating is indicated generally in FIG. 4 by reference number 300. The implement 300 includes a tube 328 having a passage 334 therethrough. The tube 328 is fabricated, for example, of plastic and the implement 300 can be used, for example, as a drinking straw and/or stirrer. At least a portion of the tube 328 is transparent and/or translucent.

An optional top 336 is affixed on an upper end 338 of the tube 328. The top 336 includes a plug 340 that fits inside the upper end 338 and a cap 342 that fits over the upper end 338. In other configurations, either the plug 340 or the cap 342 (or other means of attaching the top 336 to the tube end 338) could be used. The top 336 may be permanently attached to the tube 328 or may be removable to allow the implement 300 to be used also as a straw. The top 336 may include an ornament 344 including, for example, text and/or other indicia. The top 336 may be partly or completely transparent, opaque and/or translucent.

A housing 346 for a power source 348 is situated in the passage 334 such that (absent the top 336) a fluid may be drawn through the passage 334 past the housing 346. For example, the housing 346 may be attached by one or more spokes 352 to a lower end 356 of the tube. Thus, for example, a beverage being sucked by a user through the implement 300 flows around the spoke(s) 352 into the tube 328. In another configuration, the housing 346 may be situated asymmetrically in the passage 334, for example, attached directly to the tube 328, thereby obviating any need for spoke(s). The housing 346 may be fabricated of plastic and may be at least partly transparent and/or translucent. The housing includes an elongate extension 360, for example, a clear plastic membrane, extending into the passage 334.

The implement 300 also includes one or more light sources 364 in the tube 328 powered by the power source 348. The light source(s) 364 may include, for example, an electroluminescent wire powered by the power source 348 via a transformer 370. The electroluminescent wire 364 extends, via the housing extension 360, into the passage 334. In other configurations, other or additional types of light sources could be included in the extension 360. For example, one or more LEDs could be spaced within the extension 360 and electrically connected with the power source 348. The light source(s) 364 and/or extension 360 could also be positioned in the top 336 and/or ornament 344, preferably in a configuration wherein the top 336 is permanently affixed to the tube 328. The power source 348 is operable using a switch 382 and may include an optional control chip as previously described with reference to FIG. 1.

To use the implement 300, a user may activate the switch 382 to switch on the power source 348 and light source 364. When the light source 364 is activated, light may pass through the housing extension 360, tube 328 and optional top 336. Where the housing extension, tube and/or top are translucent, the light may cause the housing extension, tube and/or top to glow. In a configuration that includes a liquid-activatable switch 382, when the user proceeds, for example, to use the implement 300 to stir a beverage, the light source(s) 364 are switched on. It can be appreciated that a variety of lighting effects can be produced in the implement 300 and/or in a liquid or other substance surrounding at least part of the implement 300, depending on the transparency and/or translucence of various portions of the tube 328, top 336 and/or housing extension 360.

Figure 5:
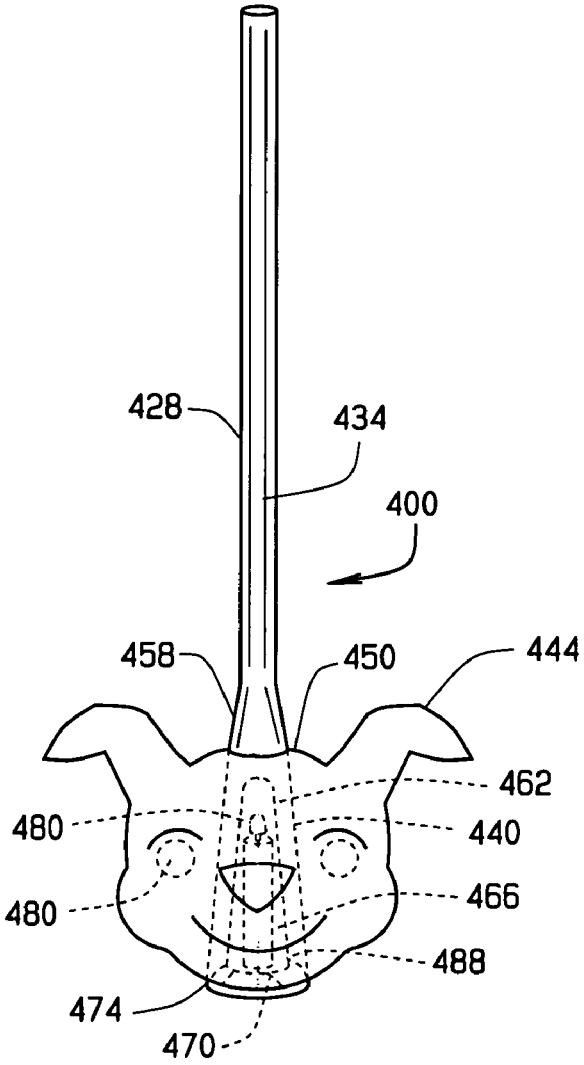
FIG. 5 is a perspective view of an implement for use in connection with drinking and/or eating in accordance with one embodiment of the present invention.

Another configuration of an implement for use in connection with drinking and/or eating is indicated generally in FIG. 5 by reference number 400. The implement 400 includes a tube 428 having a passage 434 therethrough. The tube 428 is fabricated, for example, of plastic and the implement 400 can be used, for example, as a drinking straw, stirrer and/or support for cotton candy or a frozen consumable or other consumable. At least a portion of the tube 428 is transparent and/or translucent.

As shown in FIG. 5, a lower portion 400 (shown in phantom) of the tube 428 is flared in shape and includes a display element 444. The display element 444 could be theme-related or advertisement-related and may be fabricated separately from the tube 428. The display element 444 may be made of plastic and/or other non-toxic material(s). To affix the display element 444 to the tube 428, the tube 428 may be inserted through a bore 450 of the display element. In other configurations, a display element could be attached to an outer surface 458 of the tube 428, for example, by bonding the element to the lower portion 440 (and/or to any other portion) of the tube 428. Embodiments also are contemplated in which all or part of the display element 444 is fabricated as part of the tube 428. A display element could be formed, for example, by shaping one or more chambers and optionally filling the chamber(s) with a substance as previously described with reference to FIGS. 2A and 2B.

A housing 462 for a power source 466 is situated in the passage 434 such that a fluid may be drawn through the passage 434 past the housing 462. For example, the housing 462 may be attached by one or more spokes 470 to a lower end 474 of the tube. Thus, for example, a beverage being sucked by a user through the implement 400 flows around the spoke(s) 470 into the tube 428. In another configuration, the housing 462 may be situated asymmetrically in the passage 434, for example, attached directly to the tube 428, thereby obviating any need for spoke(s). The housing 462 may be fabricated of plastic and may be at least partly transparent and/or translucent.

The implement 400 also includes one or more light sources 480 in the tube 428 and/or the display element 444 powered by the power source 466. The light source(s) 480 may include, for example, one or more LEDs, optical fibers, and/or electroluminescent wires. As shown in FIG. 5, three LEDs 480 are electrically connected with the power source 466, e.g., a battery or battery pack inside the housing 462. An electrical connection between the power source 466 and a light source 480 in or on the display element 444 may be established, for example, via a spoke 470 and/or the tube lower end 474. The power source 466 is operable using a switch 488 and may include an optional control chip as previously described with reference to FIG. 1.

To use the implement 400, a user may activate the switch 488 to switch on the power source 466 and light sources 480. When the light sources 480 are activated, light may pass through the housing 462, tube 428 and/or display element 444. It can be appreciated that a variety of lighting effects can be produced in the implement 400 and/or in a liquid or other substance surrounding at least part of the implement 400, depending on the transparency and/or translucence of various portions of the tube 428, housing 462 and/or display element 444.

Figure 6:
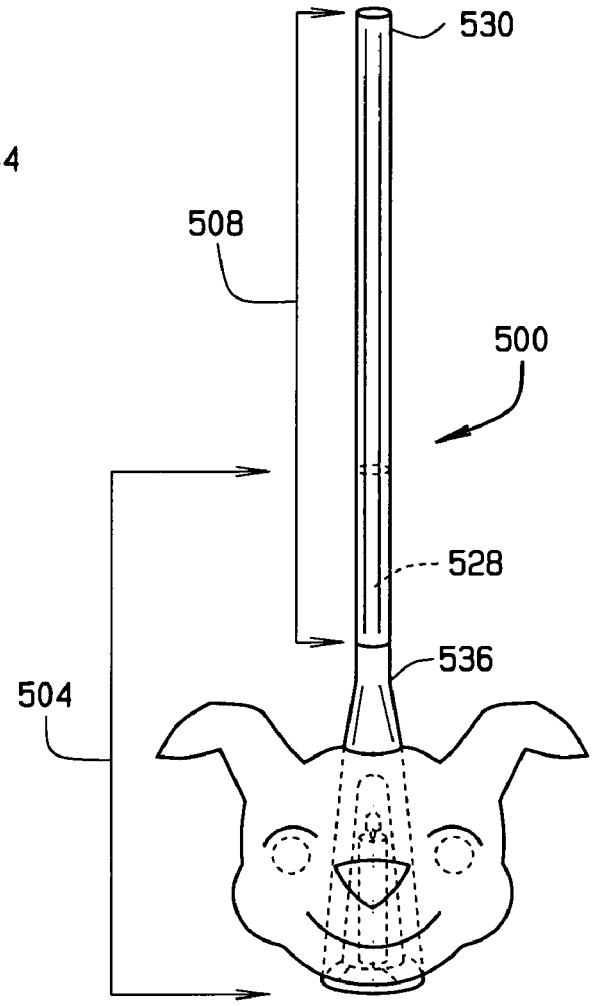
FIG. 6 is a perspective view of a combination of a drinking straw and an implement for use in connection with drinking and/or eating in accordance with one embodiment of the present invention.

A combination in accordance with another configuration of the present invention is indicated generally in FIG. 6 by reference number 500. Generally, an implement may be configured as described herein and can be used in combination with a conventional drinking straw. For example, an implement 500 similar to the implement 400 is included in the combination 500. A straw 508 is placed over a tube 528 of the implement 504 and may be pushed against a flared portion 536 of the tube 528 to provide a snug fit between the straw 508 and the implement 504. In another configuration, the straw 508 could be inserted into the tube 528. Additionally or alternatively, the straw 508 may be bonded to the implement 504. Thus, the implement 504 may be operatively connected with the straw 508 such that, when a user sucks an upper end 530 of the straw, liquid may be drawn through the combination 500. In some configurations, the implement 504 can be cleaned and/or reused with different straws.

Figure 7:
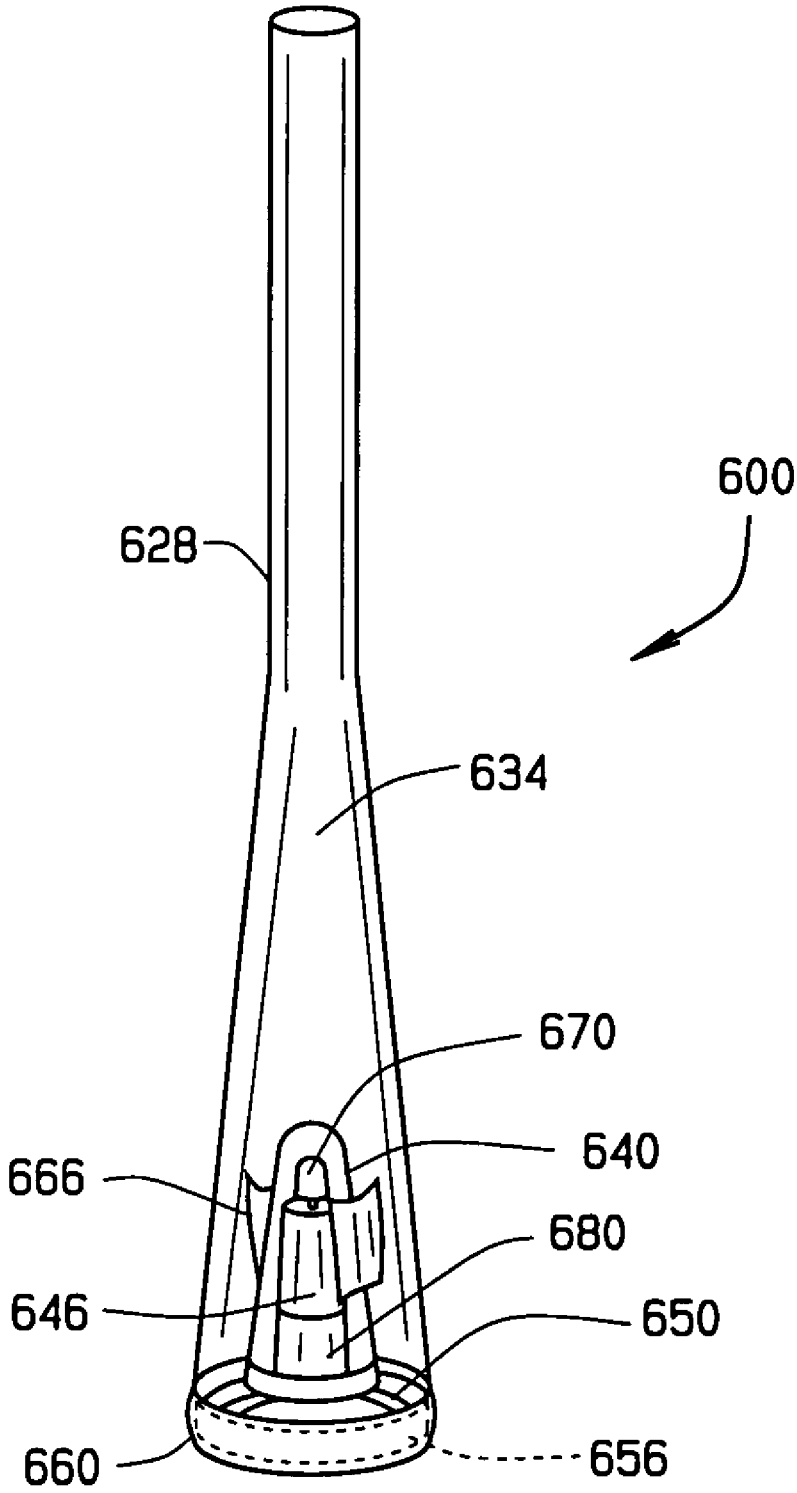
FIG. 7 is a perspective view of an implement for use in connection with drinking and/or eating in accordance with one embodiment of the present invention.

Another configuration of an implement is indicated generally in FIG. 7 by reference number 600. The implement 600 includes a tube 628 having a passage 634 therethrough. The tube 628 is fabricated, for example, of plastic. The implement 600 can be used, for example, as a drinking straw and/or stirrer. At least a portion of the tube 628 is transparent and/or translucent.

A housing 640 for a power source 646 is situated in the passage 634 such that a fluid may be drawn through the passage 634 past the housing 640. The housing 640 is attached by one or more spokes 650 to a rim 656 (shown in phantom) that may be rotated within a lower end 660 of the tube. The housing 640 may include blades 666 or may otherwise be configured to rotate with the rim 656 within the passage 634, for example, when a beverage being sucked by a user through the implement 600 flows around the spoke(s) 650 past the housing 640. The housing 640 may be fabricated of plastic and may be at least partly transparent and/or translucent.

The implement 600 includes one or more light sources 670 in the tube 628 powered by the power source 646. The light source(s) 670 may include, for example, one or more LEDs, optical fibers, and/or electroluminescent wires. As shown in FIG. 7, the light source 670 includes a LED electrically connected with the power source 646, e.g., a battery or battery pack inside the housing 640. The power source 646 is operable using a switch 680 and may include an optional control chip as previously described with reference to FIG. 1.

To use the implement 600, a user may activate the switch 680 to switch on the power source 646 and light source 670. When the light source 670 is activated, light may pass through the housing 640 and tube 628. Where the housing and/or tube are translucent, the light may cause the housing and/or tube to glow. It can be appreciated that a variety of lighting effects can be produced in the implement 600 and/or in a liquid or other substance surrounding at least part of the implement 600, depending on the transparency and/or translucence of various portions of the tube 628 and/or housing 640.

Configurations of the foregoing implement can be used as a straw and/or stirrer in connection with drinking hot and/or cold beverages and can also be used as a "stick" for cotton candy, ice cream, frozen ice or other foodstuff. Because the implement can be used in connection with hot or cold food or drink, it is contemplated that configurations of the foregoing implement could be put to uses in addition to those previously mentioned. Additionally, in some configurations, parts of the implement can be reused. For example, it is contemplated that the power source could be removed, and the remaining parts could be used as a drinking straw. The foregoing implement can provide a wide variety of illumination effects, within the implement itself and also in a transparent or translucent food or drink surrounding at least part of the implement. The implement can provide an interesting and eye-catching medium for advertising, for example, through lighted display elements and top ornaments. Text and/or indicia could also be provided on the implement and could be back-lighted by light source(s) of the implement as described above.

The description of the invention is merely exemplary in natured and, thus, variations that do not depart from the gist of the invention are intended to be within the scope of the invention. Such variations are not to be regarded as a departure from the spirit and scope of the invention.

What is claimed is:

1. An implement for use in connection with drinking and/or eating, the implement comprising:

a tube having a inner fluid flow passage therethrough in which a fluid may be received and delivered through the inner fluid flow passage;

a power source situated entirely in the inner fluid flow passage such that a fluid may be received in and drawn through the inner fluid flow passage generally around and past the power source; and one or more light sources in the tube powered by the power source.

2. The implement of claim 1, further comprising a housing for the power source positioned within the passage.

3. The implement of claim 2, wherein the housing comprises an elongate extension into the passage, at least one of the one or more light sources being disposed in the extension.

4. The implement of claim 3, wherein the at least one of the one or more light sources disposed in the extension includes at least one electrolunminescent wire extending within the elongate extension into the passage.

5. The implement of claim 2, wherein at least one of said one or more light sources are within the housing such that a fluid may be received in and drawn through the passage past the at least one light source within the housing.

6. The implement of claim 2, wherein the tube includes a surface defining the passage, and wherein the implement further includes one or more spokes attaching the housing to the tube surface defining the passage such that the housing is spaced apart from the tube surface defining the passage.

7. The implement of claim 6, wherein the one or more spokes are configured such that the housing is generally centrally positioned within the inner fluid flow passage along a longitudinal centerline axis of the inner fluid flow passage.

8. The implement of claim 2, wherein the tube includes a surface defining the passage, and wherein the housing is attached directly to the tube surface defining the passage such that the housing is situated asymmetrically within the passage.

9. The implement of claim 1, wherein the tube further comprises a sidewall, the one or more light sources in the tube comprising one or more light sources in the sidewall.

10. The implement of claim 1, wherein the tube further comprises inner and outer surfaces defining one or more chambers in a sidewall of the tube.

11. The implement of claim 10, further comprising a substance in at least one or more chambers, wherein the substance includes one or more of a gel, a hot/cold gel, a colored substance, a fluorescent substance, and a glow-in-the-dark substance.

12. The implement of claim 10, wherein the one or more light sources comprise at least one LED and at least one optical fiber extending into at least one of the one or more chambers such that light from the at least one LED is transmitted through the at least one optical fiber.

13. The implement of claim 1, wherein the implement is operatively connected with a drinking straw.

14. The implement of claim 1, wherein the tube comprises at least a portion that can be flexed.

15. The implement of claim 1, further comprising a housing for the power source mounted to the tube for rotation in the passage.

16. The implement of claim 15, wherein the housing further comprises one or more blades extending into the passage and configured such that at least a portion of a fluid received in and drawn through the passage past the housing contacts the one or more blades for causing rotation of the housing relative to the tube.

17. The implement of claim 1, wherein the tube comprises a sidewall having a plurality of different thicknesses.

18. The implement of claim 1, wherein the tube comprises a display element.

19. The implement of claim 18, wherein the display element is illuminated by at least one of the one or more light sources.

20. The implement of claim 1, wherein the tube comprises an ornamental top.

21. The implement of claim 20, wherein the ornamental top is illuminated by at least one of the one or more light sources.

22. The implement of claim 1, wherein the one or more light sources in the tube comprise one or more light sources within the passage such that a fluid may be received in and drawn through the passage past the one or more light sources within the passage.

23. A method of making an implement for use in connection with drinking and/or eating, the method comprising:

placing a power source in a housing;

inserting the housing entirely into a inner fluid flow passage of a tube such that a fluid may be received in and drawn through the inner fluid flow passage of the tube generally around and past the housing;

inserting one or more light sources into the tube; and connecting the power source to the one or more light sources.

24. The method of claim 23, further comprising configuring a display element on at least a portion of the tube.

25. The method of claim 24, further comprising illuminating the display element using the one or more light sources.

26. The method of claim 23, wherein inserting the housing into the passage comprises mounting the housing to the tube for rotation in the passage.

27. The method of claim 23, further comprising fitting a drinking straw over the tube.

28. The method of claim 23, further comprising fitting a top relative to the tube.

29. In combination with a drinking straw, an implement for use in connection with drinking through the straw, the implement comprising:

a tube having a inner fluid flow passage therethrough, at least part of the straw coupled to at least part of the tube such that a fluid can be received in and delivered through the inner fluid flow passage to the straw;

a power source situated entirely in the inner fluid flow passage of the tube such that a fluid may be received in and drawn through the inner fluid flow passage of the tube generally around and past the power source and through the straw; and one or more light sources in the tube powered by the power source.

30. The combination of claim 29, wherein the implement further comprises a housing for the power source.

31. The combination of claim 30, wherein the housing comprises an elongate extension into the passage, at least one of the one or more light sources being disposed in the extension.

32. The combination of claim 29, wherein the tube further comprises a sidewall, the one or more light sources in the tube comprising one or more light sources in the sidewall.

33. The combination of claim 29, wherein the tube further comprises inner and outer surfaces defining one or more chambers in a sidewall of the tube.

34. The combination of claim 33, wherein the tube further comprises a substance in at least one of the one or more chambers, wherein the substance includes one or more of a gel, a hot/cold gel, a colored substance, a fluorescent substance, and a glow-in-the-dark substance.

35. The combination of claim 33, wherein the one or more light sources comprise at least one LED and at least one optical fiber extending into at least one of the one or more chambers such that light from the at least one LED is transmitted through the at least one optical fiber.

36. The combination of claim 29, wherein the tube comprises at least a portion that can be flexed.

37. The combination of claim 29, further comprising a housing for the power source mounted to the tube for rotation in the passage.

38. The combination of claim 37, wherein the housing further comprises one or more blades extending into the passage and configured such that at least a portion of a fluid received in and drawn through the passage past the housing contacts the one or more blades for causing rotation of the housing relative to the tube.

39. The combination of claim 29, wherein the tube comprises a side wall having a plurality of different thicknesses.

40. The combination of claim 29, wherein the tube comprises a display element.

41. The combination of claim 40, wherein the display element is illuminated by at least one of the one or more light sources.

42. The combination of claim 29, wherein the tube comprises an ornamental top.

43. The combination of claim 42, wherein the ornamental top is illuminated by at least one of the one or more light sources.

44. An implement for use in connection with drinking and/or eating, the implement comprising:

a tube having a inner fluid flow passage therethrough in which a fluid may be received and delivered through the inner fluid flow passage;

a housing configured to receive at least one power source therein, the housing situated entirely in the inner fluid flow passage such that a fluid may be received in and drawn through the inner fluid flow passage generally around and past the housing; and one or more light sources powered by the at least one power source.

45. The implement of claim 44, wherein the housing is rotatably mounted to the tube for rotation in the passage.

46. The implement of claim 45, wherein the housing further comprises one or more blades extending into the passage and configured such that at least a portion of a fluid received in and drawn through the passage past the housing contacts the one or more blades for causing rotation of the housing relative to the tube.

47. The implement of claim 46, wherein at least one of said one or more light sources is within and rotatable along with the housing.

48. An implement for use in connection with drinking and/or eating, the implement comprising a sidewall having an inner fluid flow channel therethrough, at least one light source in the sidewall for illuminating at least a portion of the sidewall; and a housing configured to receive at least one power source therein, the housing generally centrally positioned within the inner fluid flow channel along a longitudinal centerline axis of the inner fluid flow channel such that a fluid may be received in and drawn through the inner fluid flow passage generally around and past the housing.

* * * * *

UNITED STATES PATENT AND TRADEMARK OFFICE

CERTIFICATE OF CORRECTION

PATENT NO. : 7,073,917 B2
APPLICATION NO. : 10/851510
DATED : July 11, 2006
INVENTOR(S) : Carl R. VanderSchuit It is certified that error appears in the above-identified patent and that said Letters Patent is hereby corrected as shown below:

Column 7, line 41: replace "natured" with --nature--

CLAIM 11
Column 8, line 27: insert --of the one-- before "or more chambers"

Signed and Sealed this

Twenty-first Day of November, 2006

JON W. DUDAS
*Director of the United States Patent and Trademark Office*